US011364426B2

(12) United States Patent
Brown

(10) Patent No.: US 11,364,426 B2
(45) Date of Patent: Jun. 21, 2022

(54) SKILL-CUSTOMIZED BASKETBALL GAMING

(71) Applicant: Paul Brown, Marietta, GA (US)

(72) Inventor: Paul Brown, Marietta, GA (US)

(73) Assignee: BIGSPORTS, INC., Marietta, GA (US)

( * ) Notice: Subject to any disclaimer, the term of this patent is extended or adjusted under 35 U.S.C. 154(b) by 105 days.

(21) Appl. No.: 16/870,601

(22) Filed: May 8, 2020

(65) Prior Publication Data

US 2020/0353333 A1 Nov. 12, 2020

Related U.S. Application Data

(60) Provisional application No. 62/845,031, filed on May 8, 2019.

(51) Int. Cl.

| | |
|---|---|
| ***A63B 24/00*** | (2006.01) |
| ***A63B 63/06*** | (2006.01) |
| ***A63B 71/06*** | (2006.01) |
| *A63B 63/00* | (2006.01) |

(52) U.S. Cl.

CPC ..... *A63B 63/06* (2013.01); *A63B 24/0021* (2013.01); *A63B 71/0622* (2013.01); *A63B 71/0669* (2013.01); *A63B 2024/0034* (2013.01); *A63B 2063/001* (2013.01); *A63B 2063/065* (2013.01); *A63B 2071/0655* (2013.01); *A63B 2071/0666* (2013.01); *A63B 2071/0694* (2013.01); *A63B 2210/50* (2013.01); *A63B 2220/803* (2013.01); *A63B 2225/093* (2013.01);

(Continued)

(58) Field of Classification Search

CPC ... A63B 63/06; A63B 24/0021; A63B 7/0669; A63B 2024/0034; A63B 2063/001; A63B 2063/065; A63B 2063/2071; A63B 2063/0655; A63B 2071/0666; A63B 207/0694; A63B 2210/50; A63B 2220/803; A63B 2225/093; A63B 2225/15; A63B 2243/0037

USPC ..... 273/317.3

See application file for complete search history.

(56) References Cited

U.S. PATENT DOCUMENTS 6,224,504 B1 * 5/2001 Tien ..... A63B 63/083 273/317.3

6,241,628 B1 * 6/2001 Jenkins ..... A63B 69/0071 473/436

(Continued)

*Primary Examiner* — Mitra Aryanpour

(74) *Attorney, Agent, or Firm* — Squire Patton Boggs (US) LLP

(57) ABSTRACT

A basketball gaming system may comprise at least one basketball hoop and at least one goal placement analyzer configured to adjust at least one position parameter of one or more of the at least one basketball hoops according to at least one user parameter associated with at least one user. The basketball gaming system may further comprise at least one hoop placement system configured to position the at least one basketball hoop according to the at least one position parameter. The at least one position parameter may comprise at least one x-axis coordinate, at least one y-axis coordinate, and at least one z-axis coordinate. The basketball gaming system may further comprise at least one hoop switching mechanism configured to select one or more of the at least one basketball hoops. At least one position parameter of the selected one or more basketball hoops is associated with an active status.

20 Claims, 6 Drawing Sheets

(52) U.S. Cl.
CPC ... *A63B 2225/15* (2013.01); *A63B 2243/0037* (2013.01)

(56) References Cited

U.S. PATENT DOCUMENTS

| | | | | |
|---|---|---|---|---|
| 6,267,696 | B1 * | 7/2001 | Mabe | A63B 63/083 273/397 |
| 6,554,724 | B2 * | 4/2003 | Taylor | A63B 71/0669 473/447 |
| 6,881,161 | B2 * | 4/2005 | Heflin, Sr. | A63B 69/0071 434/248 |
| 6,913,551 | B1 * | 7/2005 | Foley | A63B 63/083 473/448 |
| 7,201,676 | B2 * | 4/2007 | Rumfola, III | A63B 63/083 473/433 |
| 7,223,186 | B2 * | 5/2007 | Tresvant | A63B 69/0071 473/423 |
| 7,247,105 | B2 * | 7/2007 | Huntsberger | A63B 63/083 473/433 |
| 8,113,969 | B1 * | 2/2012 | Martin | A63B 69/0071 473/447 |
| 8,986,140 | B1 * | 3/2015 | Fuller | A63B 63/083 473/447 |
| 9,095,755 | B1 * | 8/2015 | Hill | A63B 69/0071 473/447 |
| 10,918,922 | B2 * | 2/2021 | Brey | A63B 63/083 473/470 |
| 11,141,642 | B2 * | 10/2021 | Horne | A63B 71/0622 |

* cited by examiner

Customized Basketball Gameplay Area

Variable Hoop Switching Mechanism
3 Hoop Variation

Variable Hoop Switching Mechanism
2 Hoop Variation

Basketball Hoop Placement System
Front/User View

Basketball Hoop Placement System
Top View

Software & Systems Relationships and Functions

Relationship Mapping for Gameplay Algorithm

SKILL-CUSTOMIZED BASKETBALL GAMING

This application claims the benefit of U.S. Provisional Application No. 62/845,031, filed May 8, 2020. The entire content of the above-referenced application is hereby incorporated by reference.

Certain aspects and features relate to a system and method for playing a customized basketball game. The customized basketball game allows users of varying skill levels to play a personalized game that adjusts to their skill level during game play. The customized basketball game can adjust based on a player's initial skill, overall performance over a number of game sessions, and higher or lower proficiency during a single session.

BRIEF DESCRIPTION OF THE DRAWINGS:

For a proper understanding of example embodiments. reference should be made to the accompanying drawings, wherein.

Figure 1:
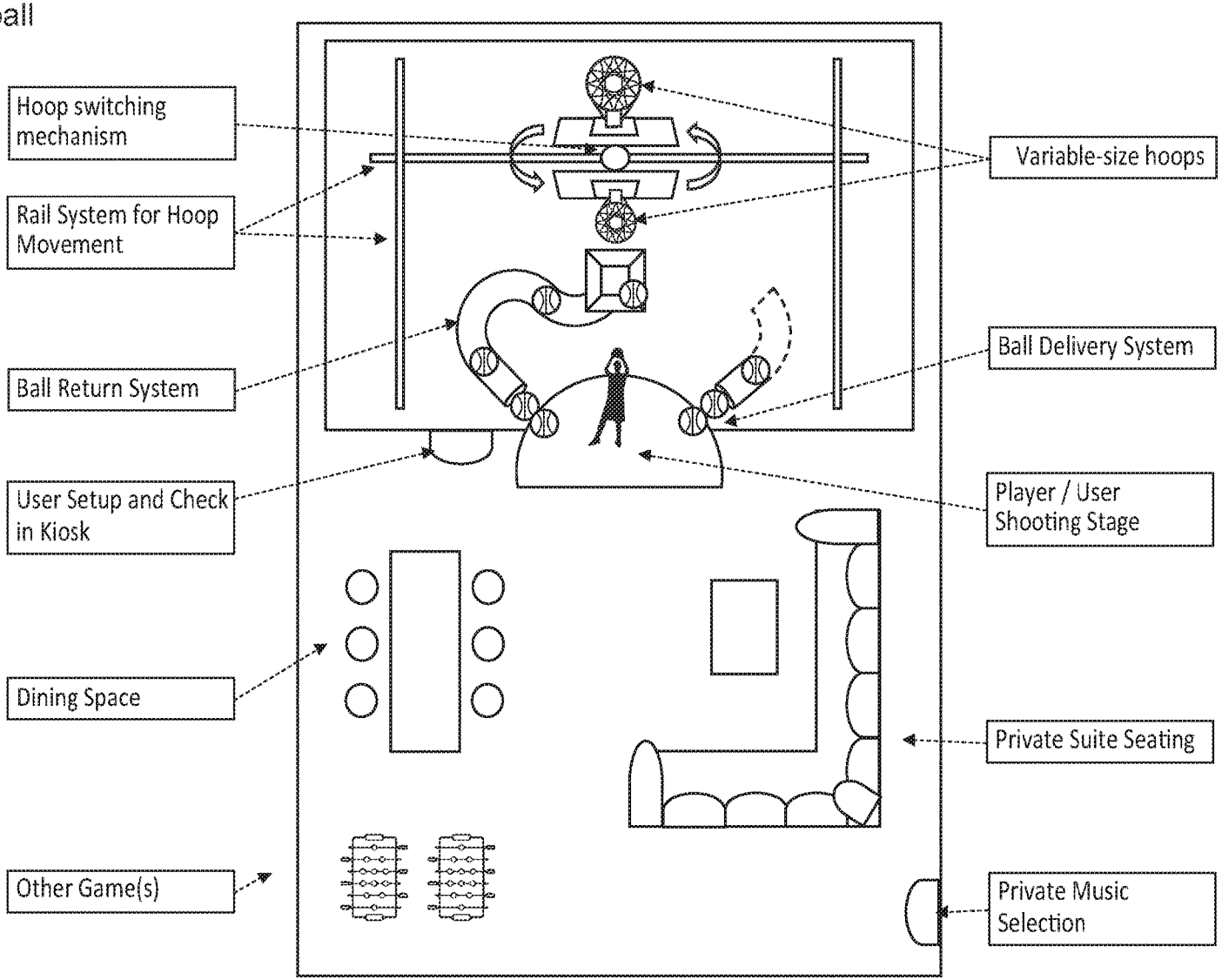
FIG. 1 illustrates an example of a customized basketball gameplay area according to certain example embodiments.

DETAILED DESCRIPTION:

FIG. 1 is a diagram of a customized basketball gameplay area according to some aspects of the present disclosure.

The customized gameplay area may contain various elements for users to interact with the customized basketball gaming system. The customized gameplay area may include the customized basketball gaming system and a lounge area for other users not interacting with the customized basketball gaming system. The customized basketball gaming system can have any combination of a user stage ("shooter stage"), an active court area, an active basketball hoop, a variable hoop switching mechanism, a basketball hoop placement system, a ball return system, and a control system. The customized basketball gaming system also includes a barrier (e.g., a low-wall) that separates the shooter stage from the active court.

The customized basketball gaming system generally can include an active hoop that is a goal target for an active user shooting a basketball. The active hoop can generally face the player to facilitate the active user aiming and shooting a basketball at the active hoop. The active hoop may be attached to a variable hoop switching mechanism or a basketball hoop placement system. The variable hoop switching mechanism may include an active hoop and any number of inactive hoops. The variable hoop switching mechanism may include a mechanism for switching the position of the active hoop and one of the inactive hoops. In some cases, the active hoop and each of the inactive hoops can be different sizes. Examples of the variable hoop switching mechanism may be described in more detail with regard to FIGS. 2A and 2B.

Figure 3B:
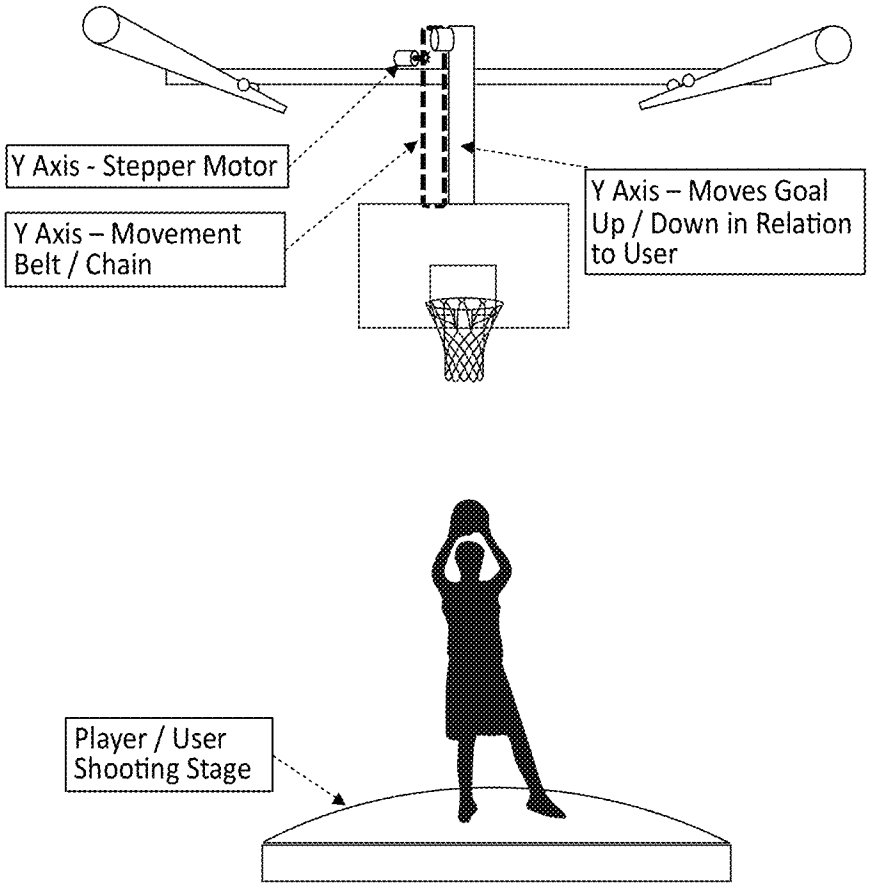
FIG. 3 illustrates an example of a basketball hoop placement system according to various example embodiments.
Figure 3A:
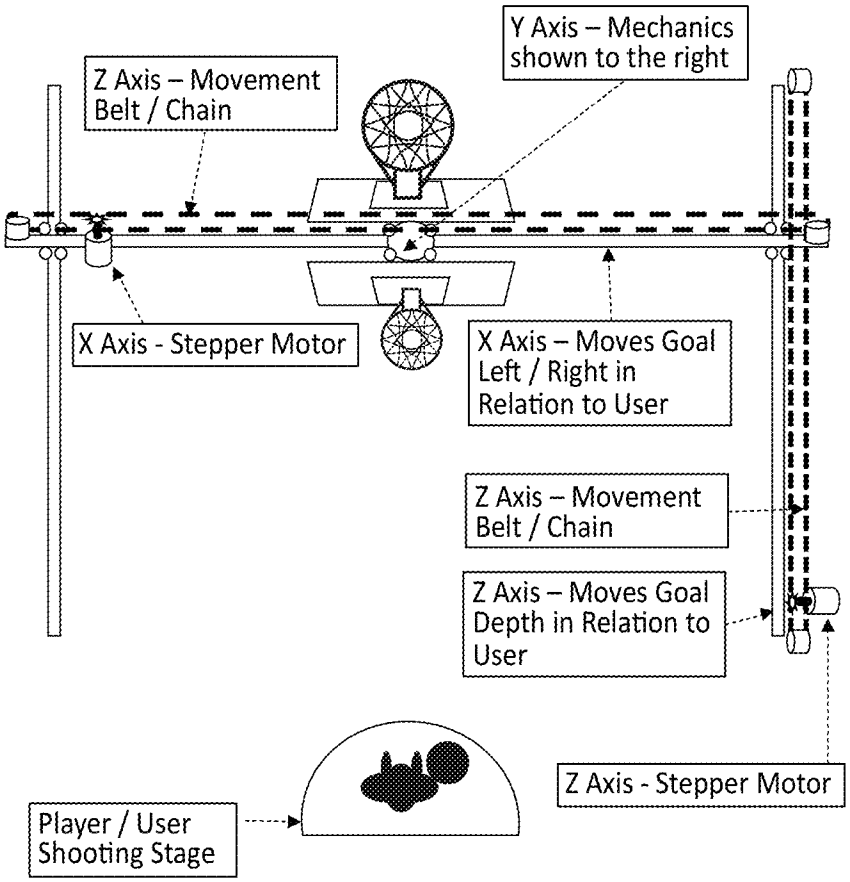

The basketball hoop placement system may include a series of rails, cables, motors, or wooden frames that move the active hoop or variable hoop switching mechanism to various positions in the active court area. The basketball hoop placement system may relocate the active hoop or variable hoop switching mechanism at any point during a game session. An example of the basketball hoop placement system is also shown in FIGS. 3A and 3B.

The customized basketball gaming system may include a ball return system and a ball delivery system. The ball return system may receive balls from the active court area and transfer them via conveyer belts, baskets, or tracks to the ball delivery system. The ball delivery system transfers a ball from the ball return system within the active court area to the shooter stage. The ball return and delivery systems may perform these operations after a single ball is received, or after a group of balls is received in a batching type operation. The ball delivery system returns the ball to the active user at the shooter stage.

The shooter stage is a location where an active user, designated by the control system, interacts with the customized basketball gaming system. The active user may be selected from a group of users. The shooter stage allows the active user to receive a basketball from the ball delivery system and attempt to shoot the basketball into the active hoop. A control system may designate the active user from a group of users that are added to a game session. A user setup kiosk may receive input from a user or group of users to be added to a game session. An example of a game session is a single game, or multiple game set. Game sessions and types of games may be best understood with regard to FIG. 4.

The customized basketball gameplay area may include a lounge area for users not currently designated as the active user. An exemplary lounge area can include a dining space, a suite of seating, an area for music/media selection, and other table games.

Figure 2B:
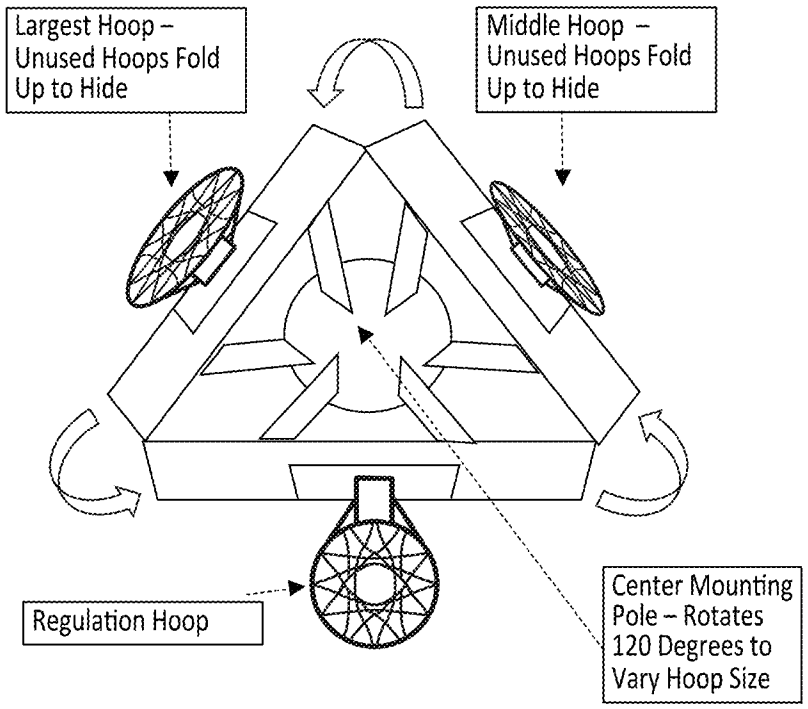
FIG. 2 illustrates examples of variable hoop switching mechanisms according to some example embodiments.
Figure 2A:
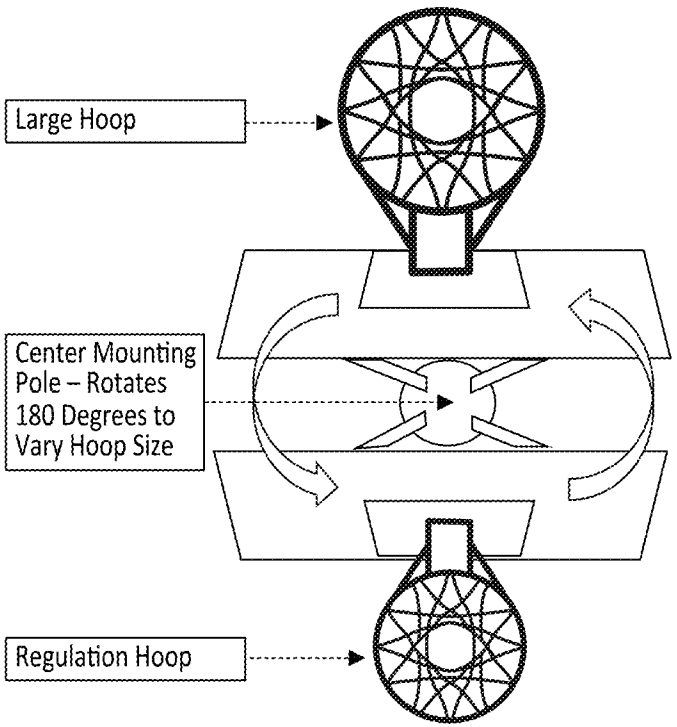

FIGS. 2A and 2B are simplified schematic diagrams of variable hoop switching mechanisms according to some aspects of the present disclosure.

The variable hoop switching mechanism may include multiple hoops of different sizes. In one example, the variable hoop switching mechanism has two hoops (e.g., regulation hoop and large hoop) that may be oriented in opposing directions, as illustrated in FIG. 2A. In an example, the variable hoop switching mechanism has a mounting pole to which the multiple hoops are attached. In one example, the mounting pole is centered and the hoops may be attached with mechanical fasteners or bolts.

In another example, the variable hoop switching mechanism may have multiple hoops, which in some cases may be three hoops, as illustrated in FIG. 2B. In an example of the variable hoop switching mechanism with a three-hoop configuration, the multiple hoops can be mounted to a mounting pole in a triangular configuration. The variable hoop switching mechanism may have 3 hoops of different sizes (e.g., regulation hoop, medium hoop, large hoop). In some examples, the inactive basketball hoops may fold along a connection point between the basketball hoop and the variable hoop switching mechanism so that the basketball hoop is positioned substantially parallel to the mounting pole as may be illustrated by FIGS. 2A and 2B.

In yet another example, the variable hoop switching mechanism may have an active hoop with an upper portion and lower portion. For example, the upper portion (i.e., the upper portion of a backboard) may be stationary while the lower portion (i.e., the lower portion of a backboard attached to the basketball hoop) may rotate to change the basketball hoop according to settings of the active hoop.

FIGS. 3A and 3B are simplified schematic diagrams of a basketball hoop placement system according to some aspects of the present disclosure.

The basketball hoop placement system may include various rails with interlocking teeth, stepper motors, belts, or chains. The basketball hoop placement system may displace the variable hoop switching mechanism around the active court area before, during, and after a gameplay session. For example, the basketball hoop placement system includes a set of rails and stepper motors to displace the variable hoop switching mechanism in an x-axis (e.g., left or right, as oriented from the shooter stage), a y-axis (e.g., vertically up or down, as viewed from the shooter stage), or a z-axis (e.g., closer or further from the shooter stage). The basketball hoop placement system may displace the variable hoop switching mechanism that may be responsive to commands from the control system based on performance of the active user.

Figure 4:
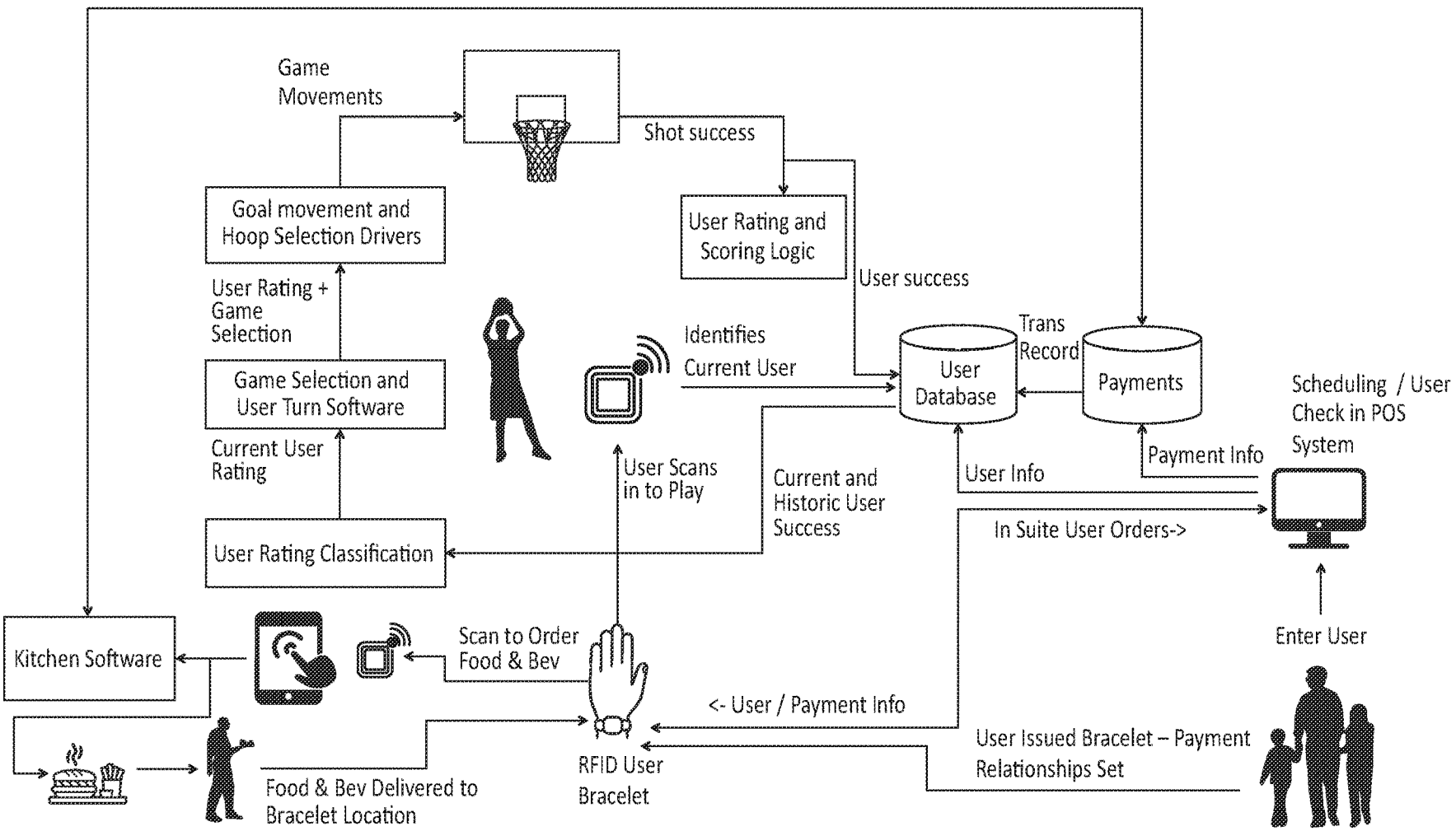
FIG. 4 illustrates an example of software & systems relationships and functions according to certain example embodiments.

FIG. 4 is a diagram of a customized basketball gameplay process, according to some aspects of the present disclosure.

The customized basketball gameplay process may begin by a user registering with a user registration system (e.g., a point of sale or user administration system) and association of a user tracking device with a particular user (e.g., an RFID/NFC wristband). The user registration system may add the particular user to a user database of all users of the customized basketball gaming system.

The customized basketball gaming system may also communicate with other systems within the entertainment establishment. For example, the customized basketball gaming system may communicate to a Kitchen Management application to order food or beverage items, request a member of the staff to visit, or authenticate and conduct payment transactions. The customized basketball gaming system can authenticate and conduct payment transactions using stored payment information of the user associated with the user tracking device of the active user.

In an example, the customized basketball game session may start when a user activates their session by scanning the user-tracking device with an active user scanner. Examples of the active user scanner may be RFID scanners, NFC readers, or magnetic code scanners. The customized basketball gaming system may designate the particular user associated with the user-tracking device as the active user. The customized basketball gaming system determines the initial player classification rating based on the particular user's previous game sessions stored in a user database. In an example where the particular user does not have a previous game session, the customized basketball gaming system may generate an initial skills test game to determine an initial player classification rating. An example of the initial skills test game is a standardized game to assess the particular user's range, accuracy, and percentage of made baskets. An alternative method of determining an initial player classification rating is by prompting the user to provide a self-reported skill level (e.g., novice, amateur, expert, etc.).

The customized basketball gaming system may determine the initial player classification rating of multiple players scanning additional user tracking devices into the customized basketball game session. The customized basketball gaming system may input some or all of the players into a customized basketball game session. Examples of customized basketball game sessions are a single game, a multi-game time period, or a predefined series of games (e.g., a predefined competition). The customized basketball gaming system may prompt the multiple users added to the customized basketball game session to select a game type.

The customized basketball gaming system may determine the composition of the customized basketball game session with a group of users and one or more game types. The customized basketball gaming system determines an active user (e.g., an "active player" or "shooter") to initiate the active user's turn within the customized basketball game session. In some cases, the customized basketball gaming system may notify the active user through a haptic alert to the user-tracking device of the active user. In additional or other cases, the customized basketball gaming system may notify the active user through visual cues on a presentation screen or lighting visual aids.

The customized basketball gaming system activates the active user's turn when the active user scans its user-tracking device with the active user scanner near the shooter stage. The customized basketball gaming system may activate initial settings on the variable hoop switching mechanism or the hoop placement system based on the active user's player classification rating and the type of game selected. The customized basketball gaming system may detect that the active user is within the shooting stage area and notify the active user by audio and visual cues that a scored portion of the active user's turn is commencing.

The customized basketball gaming system may activate the scored portion and provide a first ball to the active user via the ball delivery system. The active user may shoot the first ball towards the active hoop in an attempt to make a basket. A "made basket" is defined by the basketball proceeding through the active hoop. The customized basketball gaming system may determine that a basketball not detected as proceeding through the active hoop (e.g., detected by the ball return system prior to the active hoop), may be defined as a "missed basket." The customized basketball gaming system returns the first ball to the shooting stage via the ball return system and the ball delivery system. The customized basketball gaming system can provide second or additional balls to the active user at the shooting stage while the first ball is in the active court area, ball return system, or ball delivery system.

In one example, the customized basketball gaming system can detect a made basket by a mechanical shot detection lever that is displaced by a basketball proceeding through the rim in the direction from a top side of the active hoop to the bottom side of the active hoop. In another example, the customized basketball gaming system may use a chip detector within the active hoop in combination with a chip in the basketball to detect a made basket.

The customized basketball gaming system determines a score of the active user based on a made basket. The customized basketball gaming system may apply weight or other adjustments to the score of the active user based on skill level, made basket streak, game type, and other factors.

The customized basketball gaming system may move the active hoop via the hoop placement system or change hoop types via the variable hoop switching mechanism based on multiple factors, including the outcome of the most recently scored shot by the active user, a most recent trend of scored shots within a game session, and a general trend of scored shots across multiple game sessions.

Figure 5:
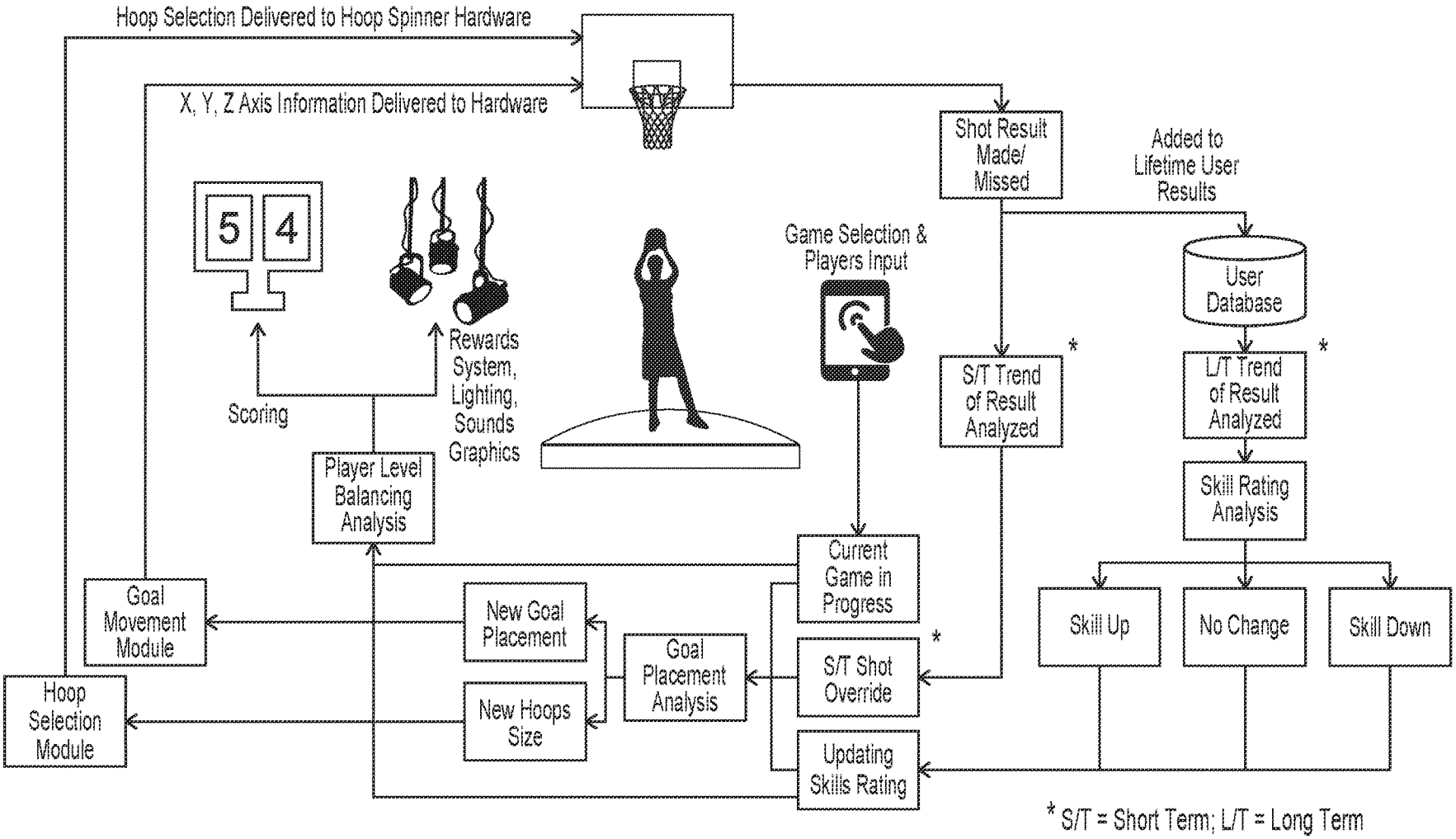
FIG. 5 illustrates an example of a relationship mapping for gameplay algorithm according to some example embodiments.

FIG. 5 is a flowchart of a customized basketball gaming scoring method, according to some aspects of the present disclosure.

The customized basketball gaming system may compute the score of a user, adjust the player classification rating, adjust the skill level, and perform trend analysis for multiple users during a customized basketball game session. The customized basketball gaming system may determine the settings for the variable hoop switching mechanism and the hoop placement system based on one or more of these computations. One or more of the operations or computations described herein may be performed by one or more computing devices that may be local to the customized basketball gaming system or remotely accessed by the customized basketball gaming system.

In an example, the customized basketball gaming system determines, during a customized basketball game session, that the active user's most recent shot attempt was a successfully made basket. The customized basketball gaming system stores the made basket in a profile of the active user, such as a user database that stores multiple shot results from the active user. The customized basketball gaming system computes a short term trend and a long term trend for the active user. It should be appreciated by one of skill in the art that a computation may be performed after each shot attempt or as a series.

For example, the active user has attempted a series of shots, the results of which are scored as [Made, Missed, Missed, Made, Made, Made]. In some cases, the scoring of the shot attempts can be binary values [1, 0, 0, 1, 1, 1]. The customized basketball gaming system may compute the short term trend as an improving trend given that a percentage of the shot attempts resulting in made baskets is increasing as the sequence progresses. Examples of the percentages of made baskets to shot attempts in this example would be [100, 50, 33.3, 50, 60, 66.6%]. Accordingly, the short-term trend initially shows a decreasing trend, followed by an increasing trend for the remainder of the series. The customized basketball gaming system can vary the length of the short-term trend based on game type, skill level, and other factors.

The customized basketball gaming system can compute a long-term trend to analyze the active user's performance over multiple customized basketball game sessions, up to and including the entire shot history of the active user including all previous customized basketball game sessions. In some cases, the long-term trend may be a series of percentages as described above, but is not so limited. Other examples of long-term trend computations can include rolling averages of made baskets across multiple customized basketball game sessions, maximum/minimum made baskets in a particular game type, maximum/minimum made baskets across all game types, or statistics about the performance of the active user across a single or multiple time periods (e.g., month-month comparison, year-over-year comparison, etc.).

The customized basketball gaming system may determine an adjustment of the settings for the variable hoop switching mechanism or the hoop placement system based on the short-term trend. For example, the customized basketball gaming system computes a short-term trend for the active user that indicates the active user is decreasing the amount of made baskets. The customized basketball gaming system may determine that a larger hoop would improve the performance of the active user. The customized basketball gaming system may cause a hoop selection module to select a larger active hoop. The hoop selection module communicates the new active hoop setting to the variable hoop switching mechanism. The variable hoop switching mechanism may adjust the active hoop to reflect the adjusted setting. In a similar example, the customized basketball gaming system may determine that an active hoop that is closer to the user would improve the performance of the active user. The customized basketball gaming system may cause a goal movement module to determine a new position for the active hoop closer to the shooting stage. The goal movement module communicates the new active hoop setting to the hoop placement system. The hoop placement system may adjust the active hoop to reflect the adjusted setting.

The customized basketball gaming system may determine an adjustment to the player classification rating or skill level based on the long-term trend. For example, the customized basketball gaming system computes a long-term trend for the active user that indicates the active user is decreasing the amount of made baskets. The customized basketball gaming system may determine that a lower skill level would improve the performance of the active user. An example of moving an active user to a lower skill level may be by adjusting the settings of the customized basketball game session (e.g., hoop initializes closer, initializes with larger active hoop, less distraction with lighting, etc.). The customized basketball gaming system may store the adjustments in the user database associated with the profile of the active user as well as update the skill level or player classification rating associated with the user.

The customized basketball gaming system may apply a weighting factor (e.g., a handicap metric) to the active user based on skill level, short-term trend, and long term trend. For example, a first user at a lower skill level (e.g., skill level 2) might receive a similar or greater point value score for a particular shot attempt when compared with a point value score that a second user at a higher skill level (e.g., skill level 7) would receive for an identical shot attempt. The customized basketball gaming system may also award bonus points for achievements such as streaks of made baskets, total quantity of made baskets, or percentage of made baskets within a customized basketball game session or game type. The customized basketball gaming system may also position the active hoop for each active user such that a difficulty level approximates a similar shot attempt. For example, the customized basketball gaming system may present the first user having a lower skill level with an active hoop that is closer to the shooting stage and larger, while the customized basketball gaming system may present the second user (having a higher skill level) with an active hoop that is more distant from the shooting stage and smaller. The customized basketball gaming system may also adjust the lighting brightness, sound level, or visual complexity to approximate similar shot attempts based on the skill level of a user.

The customized basketball gaming system may also adjust the lighting, sounds, graphical presentations, smoke effects, or laser lighting effects based on the outcome of a particular shot attempt, specific short term or long term trends (e.g., short term streak of 5 consecutive made baskets, long term streak of 90% made baskets, etc.). The customized basketball gaming system may also prompt the active user to participate in customized basketball game sub-sessions ("mini games") within a customized basketball game session. The customized basketball gaming system may determine a type and length of the mini game, the bonus points achieved during the mini game, and what criteria determine when the active user is prompted to participate in a particular mini game.

In some examples, the customized basketball gaming system may track the basketball shot from the shooting stage along the flight path of the basketball. The customized basketball gaming system can track the ball using a computer vision camera, or object tracking devices (e.g., radar, multiple camera system, etc.). The customized basketball gaming system can provide visual feedback to the active user based on a flight path of the basketball and deviation from the ideal flight path that would have resulted in a made basket. The customized basketball gaming system can provide cues to the active player via visual, text, or audio communications to remediate the active user's basketball shot form.

The customized basketball gaming system may have multiple game types. Exemplary game types include Traditional, BigHoops, Sharpshooter, Horse, Rapid Fire, and Carnival.

In some embodiments, motion sensors, computer vision, and/or artificial intelligence may track the basketball when a user attempts a shot on the active basket. As an example, computer-generated graphics may display the path of the shot arc, shot statistics such as shot length, basketball goal distance, and/or user success and scoring feedback. The computer-generated graphics may be displayed to the user on a screen and/or on glasses worn by the user which are configured to overlay computer images onto the user's field of view. Furthermore, overlaying computer-generated graphics may support creating additional basketball games for the user. For example, the user may be prompted to participate in a passing challenge where at least one basketball player is computer-generated, and the user is prompted to pass the ball to a teammate in motion without passing to defending players. The overlaying of computer-generated graphics may further enhance the user experience by simulating other basketball game aspects such as crowds, referees, basketball flooring, scoreboards, mascots, cheerleaders, coaches, and other basketball players.

Figure 6:
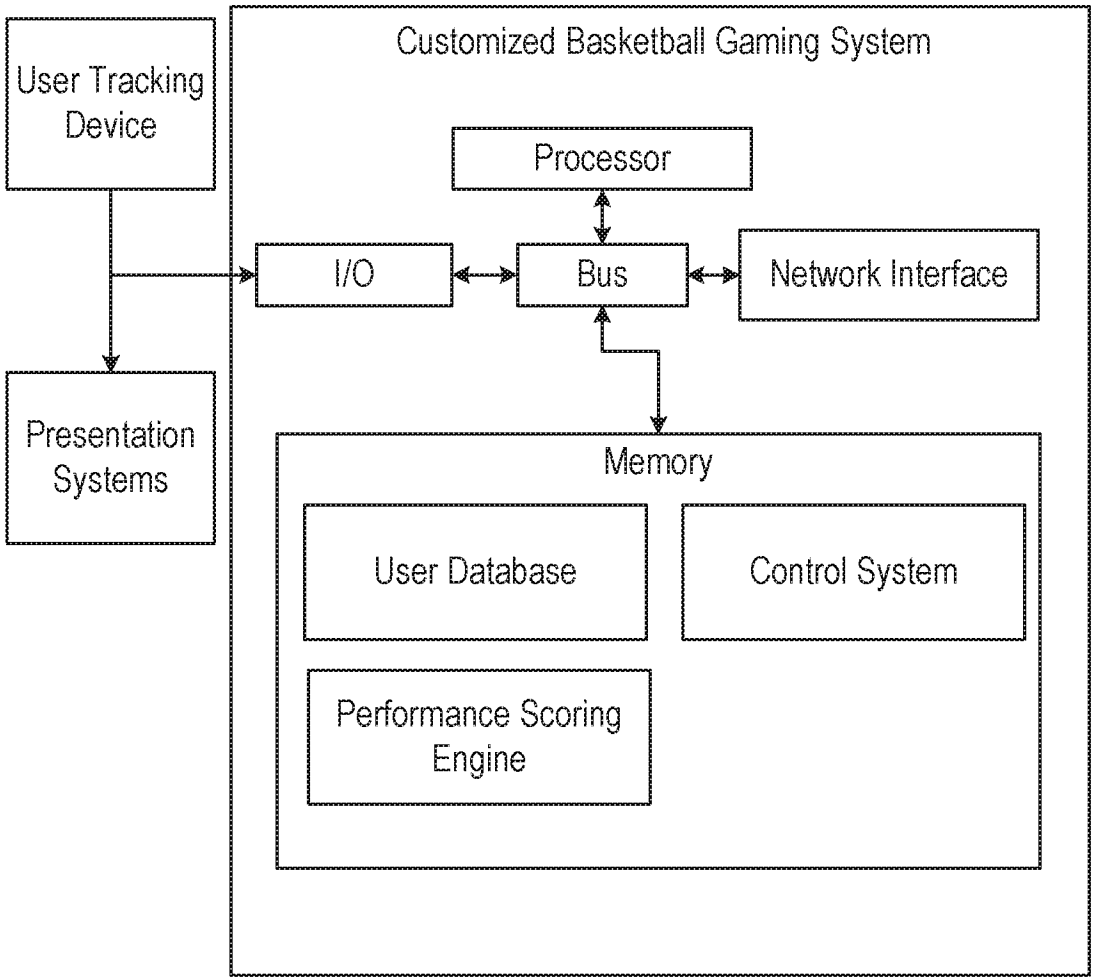
FIG. 6 illustrates an example of a customized basketball gaming system according to various example embodiments.

Any suitable computing system or group of computing systems can be used to perform the operations for customizing a basketball game as described herein. For example, FIG. 6 is a block diagram depicting an example computing system for executing a customized basketball gaming system.

The customized basketball gaming system can include various devices for performing one or more customized basketball game operations described above with respect to FIGS. 1-5. The customized basketball gaming system can include a processor that is communicatively coupled to a memory storage device. The processor executes computer-executable program code stored in the memory, accesses information stored in the memory, or both. Program code may include machine-executable instructions that may represent a procedure, a function, a subprogram, a program, a routine, a subroutine, a module, a software package, a class, or any combination of instructions, data structures, or program statements. A code segment may be coupled to another code segment or a hardware circuit by passing or receiving information, data, arguments, parameters, or memory contents. Information, arguments, parameters, data, etc. may be passed, forwarded, or transmitted via any suitable means including memory sharing, message passing, token passing, and network transmission, among others.

Examples of a processor include a microprocessor, an application-specific integrated circuit, a field-programmable gate array, or any other suitable processing device. The processor can include any number of processing devices, including one. The processor can include or communicate with a memory. The memory stores program code that, when executed by the processor, causes the processor to perform the operations described in this disclosure.

The memory can include any suitable non-transitory computer-readable medium. The computer-readable medium can include any electronic, optical, magnetic, or other storage device capable of providing a processor with computer-readable program code or other program code. Non-limiting examples of a computer-readable medium include a magnetic disk, memory chip, optical storage, flash memory, storage class memory, ROM, RAM, an ASIC, magnetic storage, or any other medium from which a computer processor can read and execute program code. The program code may include processor-specific program code generated by a compiler or an interpreter from code written in any suitable computer-programming language. Examples of suitable programming language include Hadoop, C, C++, C#, Visual Basic, Java, Python, Perl, JavaScript, ActionScript, etc.

The customized basketball gaming system may also include a number of external or internal devices such as input or output devices. For example, the customized basketball gaming system is shown with an input/output interface that can receive input from input devices or provide output to output devices. A bus can also be included in a customized basketball gaming system. The bus can communicatively couple one or more components of the customized basketball gaming system.

The customized basketball gaming system can execute program code that includes the control system and performance scoring engine. The program code may be resident in any suitable computer-readable medium and may be executed on any suitable processing device. For example, as depicted in FIG. 6, the program code can reside in the memory. Executing the customized basketball gaming system can configure the processor to perform the operations described herein.

In some aspects, the customized basketball gaming system can include one or more output devices. One example of an output device is the network interface device depicted in FIG. 6. A network interface device can include any device or group of devices suitable for establishing a wired or wireless data connection to one or more data networks described herein. Non-limiting examples of the network interface device include an Ethernet network adapter, a modem, etc.

The control system can include various devices for performing one or more movement/machine activation operations (i.e., variable hoop switching mechanism, hoop placement system, etc.) described above with respect to FIGS. 1-5. The control system can include a processor that is communicatively coupled to a memory. The processor executes computer-executable program code stored in the memory, accesses information stored in the memory, or both. Program code may include machine-executable instructions that may represent a procedure, a function, a subprogram, a program, a routine, a subroutine, a module, a software package, a class, or any combination of instructions, data structures, or program statements. A code segment may be coupled to another code segment or a hardware circuit by passing or receiving information, data, arguments, parameters, or memory contents. Information, arguments, parameters, data, etc. may be passed, forwarded, or transmitted via any suitable means including memory sharing, message passing, token passing, network transmission, among others.

GENERAL CONSIDERATIONS

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification, terms such as "processing," "computing," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provides a result conditioned on one or more inputs. Suitable computing devices include multipurpose microprocessor-based computing systems accessing stored software that programs or configures the computing system from a general purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

Aspects of the methods disclosed herein may be performed in the operation of such computing devices. The order of the blocks presented in the examples above can be varied—for example, blocks can be re-ordered, combined, or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific aspects thereof, it will be appreciated that those skilled in the art, upon attaining an understanding of the foregoing, may readily produce alterations to, variations of, and equivalents to such aspects. Any aspects or examples may be combined with any other aspects or examples. Accordingly, it should be understood that the present disclosure has been presented for purposes of example rather than limitation, and does not preclude inclusion of such modifications, variations, or additions to the present subject matter as would be readily apparent to one of ordinary skill in the art.

I claim:

1. A basketball gaming system, comprising:

at least one basketball hoop;

at least one hoop switching mechanism configured to adjust at least one position of the at least one basketball hoop in relation to the at least one hoop switching mechanism according to at least one position parameter;

at least one hoop placement system configured to adjust at least one position of the at least one hoop switching mechanism in relation to at least one stage area according to the at least one position parameter; and at least one control system configured to control the at least one hoop switching mechanism and the at least one hoop placement system.

2. The basketball gaming system of claim 1, wherein the at least one position parameter comprises at least one x-axis coordinate, at least one y-axis coordinate, and at least one z-axis coordinate.

3. The basketball gaming system of claim 1, wherein the basketball gaming system comprises at least two basketball hoops, and the at least one hoop switching mechanism is configured to:

select one of the at least two basketball hoops, wherein the selected basketball hoop is associated with an active status, and at least one unselected basketball hoop is associated with an inactive status.

4. The basketball gaming system of claim 3, wherein the at least one basketball hoop comprises a plurality of hoop diameters.

5. The basketball gaming system of claim 3, wherein the at least one stage area is configured to:

allow basketball shots by the at least one user towards at least one basketball hoop associated with an active status.

6. The basketball gaming system of claim 1, further comprising:

at least one ball return system configured to transfer at least one basketball to the stage area.

7. The basketball gaming system of claim 1, wherein the at least one position parameter is based upon one or more of:

at least one initial user skill level associated with the user;

at least one intra-game user skill level associated with the user; and at least one inter-game skill level associated with the user.

8. The basketball gaming system of claim 7, wherein the at least one initial user skill level is based on at least one of:

at least one predefined skill level reported by the user; and at least one standardized game configured to determine one or more of:

maximum range associated with the user;

accuracy associated with the user; and percentage of successful goals associated with the user.

9. The basketball gaming system of claim 8, wherein the at least one control system is further configured to:

adjust the at least one intra-game user skill level based on a number of successful basketball shots detected during an active game; and adjust the at least one inter-game user skill level based on a number of successful basketball shots detected during at least one completed game.

10. The basketball gaming system of claim 9, wherein the at least one position parameter is based upon at least two intra-game user skill levels associated with the user, and adjusting one or more of the at least two intra-game user skill levels and the at least one inter-game user skill further comprises:

apply at least one weighting factor to at least one score of the at least one user based on the at least two intra-game user skills, the at least one inter-game user skill, at least one made basket streak, and at least one game type.

11. The basketball gaming system of claim 9, wherein the adjusting the at least one intra-game user skill level further comprises:

determining at least one intra-game trend based upon a percentage of successful shot attempts.

12. The basketball gaming system of claim 9, wherein adjusting the at least one inter-game user skill level further comprises:

determining at least one inter-game trend based on the performance of the at least one user over a plurality of basketball games.

13. The basketball gaming system of claim 9, wherein the adjusting the at least one inter-game user skill level further comprises:

determining at least one inter-game trend based on one or more of at least one rolling average of made baskets during a plurality of basketball games, a maximum number of made baskets in a particular game type, a minimum number of made baskets in a particular game type, a maximum number of baskets across all game types, a minimum number of baskets across all game types, and at least one performance metric associated with the at least one user across at least one time period.

14. The basketball gaming system of claim 1, wherein the at least one control system is further configured to:

activate at least one game when at least one user-tracking device associated with the user is detected;

activate one or more of at least one initial setting of the hoop switching mechanism and at least one initial setting of the hoop placement system; and activate at least one sensory notification in response to at least one scored portion of the at least one game commencing.

15. The basketball gaming system of claim 14, wherein the at least one user-tracking device comprises one or more of at least one radio-frequency identification scanners, at least one near-field communication reader, and at least one magnetic code scanner.

16. The basketball gaming system of claim 1, further comprising:

at least one user registration system configured to register at least one user with the basketball gaming system, associate at least one user tracking device with the at least one user, and add the at least one user to at least one user database storing all users of the basketball gaming system.

17. The basketball gaming system of claim 1, further comprising one or more of:

at least one motion sensor configured to track basketballs shot towards the at least one basketball hoop;

at least one display configured to display at least one of shot arc path, shot length, basketball goal distance, and scoring feedback; and at least one pair of glasses configured to overlay computer-generated graphics onto the user's field of view when worn by the user.

18. A non-transitory computer-readable medium comprising program instructions stored thereon for performing at least the following:

select at least one of a plurality of basketball hoops, wherein at least one of the selected one or more basketball hoops is associated with an active status, and at least one of the at least one unselected basketball hoops is associated with an inactive status;

adjust at least one position of the at least one basketball hoop in relation to at least one hoop switching mechanism according to the status; and adjust at least one position of at least one hoop switching mechanism in relation to at least one stage area according to the at least one position parameter, wherein the at least one position parameter comprises one or more of at least one x-axis coordinate, at least one y-axis coordinate, and at least one z-axis coordinate.

19. An apparatus, comprising:

at least one basketball hoop;

at least one hoop switching mechanism configured to adjust at least one position of the at least one basketball hoop in relation to the at least one hoop switching mechanism according to at least one position parameter; and at least one hoop placement system configured to adjust at least one position of the at least one hoop switching mechanism in relation to at least one stage area according to the at least one position parameter, wherein the at least one position parameter comprises one or more of at least one x-axis coordinate, at least one y-axis coordinate, and at least one z-axis coordinate, and the at least one hoop placement system comprises one or more of at least one rail with interlocking teeth, at least one stepper motor, at least one belt, and at least one chain.

20. The apparatus of claim 17, further comprising:

at least one mechanical shot detection sensor configured to detect at least one basketball moving from a top side of at least one active basketball hoop to the bottom side of the at least one active basketball hoop.

* * * * *